United States Patent [19]

Hughes

[11] Patent Number: 4,734,031

[45] Date of Patent: Mar. 29, 1988

[54] VESSEL FOR HOLDING HIGH TEMPERATURE BULK MATERIALS

[75] Inventor: John T. Hughes, Worcester, United Kingdom

[73] Assignee: Micropore International Limited, Droitwich, England

[21] Appl. No.: 924,875

[22] Filed: Oct. 30, 1986

[30] Foreign Application Priority Data

Oct. 30, 1985 [GB] United Kingdom ..... 8526669

[51] Int. Cl.[4] ..... F27D 1/00; F27B 14/00

[52] U.S. Cl. ..... 432/264; 432/247; 432/248

[58] Field of Search ..... 432/262, 264, 247, 248, 432/252; 110/336

[56] References Cited

U.S. PATENT DOCUMENTS

| | | | |
|---|---|---|---|
| 1,605,885 | 11/1926 | Willetts | 432/248 |
| 2,947,114 | 8/1960 | Hill | 432/264 |
| 2,985,442 | 5/1961 | Hilber | 432/247 |
| 3,148,238 | 9/1964 | Willenbrock, Jr. | 423/248 |
| 3,328,017 | 6/1967 | Conner | 432/264 |
| 3,345,059 | 10/1967 | Swindt | 432/264 |
| 3,779,699 | 12/1973 | Russell et al. | 432/248 |
| 3,802,833 | 4/1974 | Weber | 432/248 |
| 4,325,694 | 4/1982 | Bergman | 432/247 |

*Primary Examiner*—Henry C. Yuen

*Attorney, Agent, or Firm*—Browdy and Neimark

[57] ABSTRACT

A vessel for holding high temperature bulk materials, such as a ladle for handling molten metal, includes a steel bucket containing a permanent outer layer of refractory material. Within the outer layer is an expendable layer which is made up from relatively rigid boards of compacted microporous thermal insulation material. Within the layer of microporous thermal insulation material is a further expendable layer of refractory material which covers the inner surface of the layer of microporous thermal insulation material. The thermal capacity of the expendable layer of refractory material is preferably less than the thermal capacity of the permanent outer layer of refractory material.

6 Claims, 2 Drawing Figures

VESSEL FOR HOLDING HIGH TEMPERATURE BULK MATERIALS

FIELD OF THE INVENTION

The present invention relates to vessels for holding high temperature bulk materials and more particularly, but not exclusively, relates to ladles which are used for handling molten metals.

DESCRIPTION OF PRIOR ART

It is normal practice in a foundry to produce a molten metal by heating a mixture of ores and other ingredients in a furnace. The molten metal is then poured into a ladle for transportation from the furnace to a region of the foundry where the molten metal is to be poured into casting moulds.

The ladle generally comprises an outer casing in the form of a bucket, made of steel for example, which is lined with a refractory material that is able to withstand contact with the molten metal. The ladle is not provided with its own heating system, but the temperature of the ladle is usually raised in a preheating step before the molten metal is poured into the ladle from the furnace. Preheating may be accomplished, for example, by applying a gas flame to the refractory lining of the ladle. It is desirable that molten metal should be held in the ladle at a temperature which is as constant as possible for a period of typically 20 to 60 minutes.

It has been proposed to use a two layer lining system in which a durable refractory material is in contact with the molten metal and a layer of thermal insulation material is arranged between the refractory material and the metal bucket. Such a lining system has the advantage of low thermal conductivity through the lining system combined with durability which permits the ladle to be used about 50 to 100 times before renewal of the lining system becomes necessary.

A further lining system has been proposed which combines durability and low thermal conductivity with safety in case of accidental fracture of the refractory in contact with the molten metal. In such a system, a further layer of refractory material is positioned between the bucket and a layer of loose particulate thermal insulation material.

These low thermal conductivity lining systems exhibit a small, but noticeable, improvement in performance over the traditional single layer of refractory material. That is to say, the surface temperature of the bucket drops significantly and the temperature drop in the molten metal is slightly smaller compared with the single layer system. However, the temperature drop is still very considerable and it is highly desirable to improve the lining system further.

OBJECT OF THE INVENTION

It is therefore an object of the present invention to provide an improved lining system for vessels which hold high temperature bulk materials.

SUMMARY OF THE INVENTION

According to the present invention there is provided a vessel for holding high temperature bulk materials, the vessel comprising:

an outer casing;

a permanent refractory lining covering the inner surface of the casing;

an expendable layer of relatively rigid boards of compacted microporous thermal insulation material covering the inner surface of the permanent refractory lining; and an expendable layer of refractory material covering the inner surface of the layer of microporous thermal insulation material.

Microporous thermal insulation materials are materials which have a lattice structure in which the average interstitial dimension is less than the mean free path of the molecules of air or other gas in which the material is arranged. This results in a heat flow which is less than that attributable to the molecular heat diffusion of air or other gas in which the material is used. The lattice structure is created within a powder material by using a powder with very fine particles in a chain-like formation which adhere to each other. A suitable powder for providing this structure is finely divided silica in the forms normally referred to as silica aerogel and pyrogenic silica, although other materials are also available. The powder may be strengthened by the addition of a reinforcing fibre such as ceramic fibre and an opacifier may be added to provide infra-red opacification.

The thermal capacity of the expendable layer of refractory material may be less than the thermal capacity of the permanent refractory lining and is preferably substantially 50 percent of the thermal capacity of the permanent refractory lining.

Thermal capacity is defined herein as being the quantity of heat required to raise the temperature of a system by one degree.

Preferably, the expendable layer of refractory material is made from a substantially non-porous refractory material.

The expendable layer of refractory material may be made from a substantially non-porous refractory material and may contain a relatively high proportion of alumina. Additionally, the expendable layer of refractory material may contain silicon carbide.

The compacted microporous thermal insulation material may be contained within a glass fibre envelope. It may be advantageous if a plurality of adjacent boards are contained within a single glass fibre envelope.

For a better understanding of the present invention and to show more clearly how it may be carried into effect reference will now be made, by way of example, to the accompanying drawings in which:

DESCRIPTION OF PREFERRED EMBODIMENT

Figure 1:
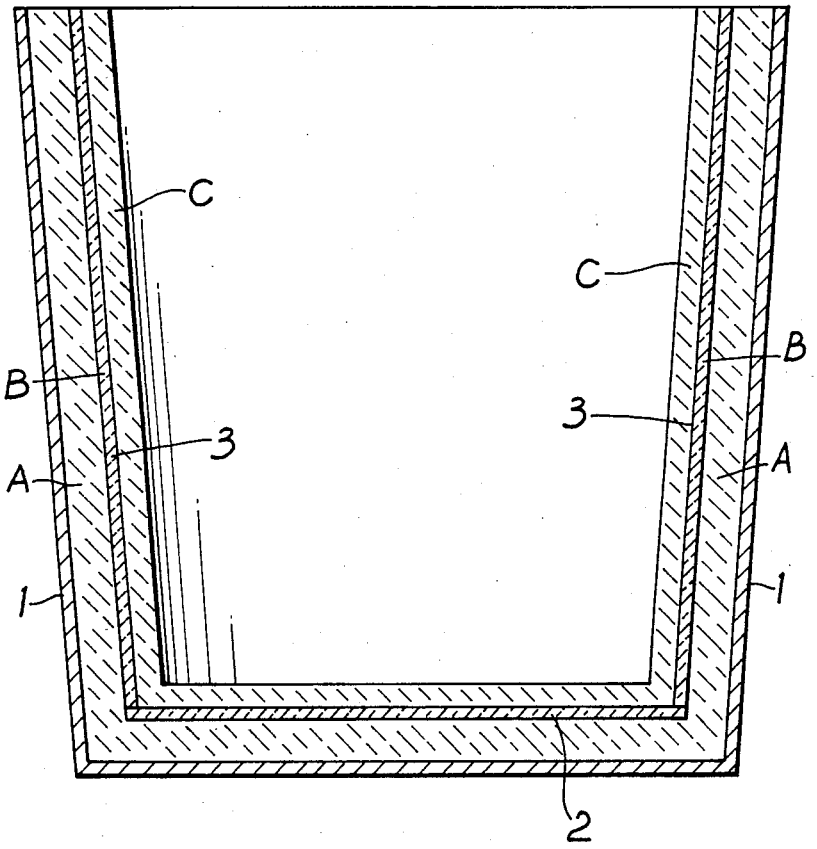
FIG. 1 is a schematic cross-sectional illustration of a vessel according to the present invention for holding high temperature bulk material.
Figure 2:
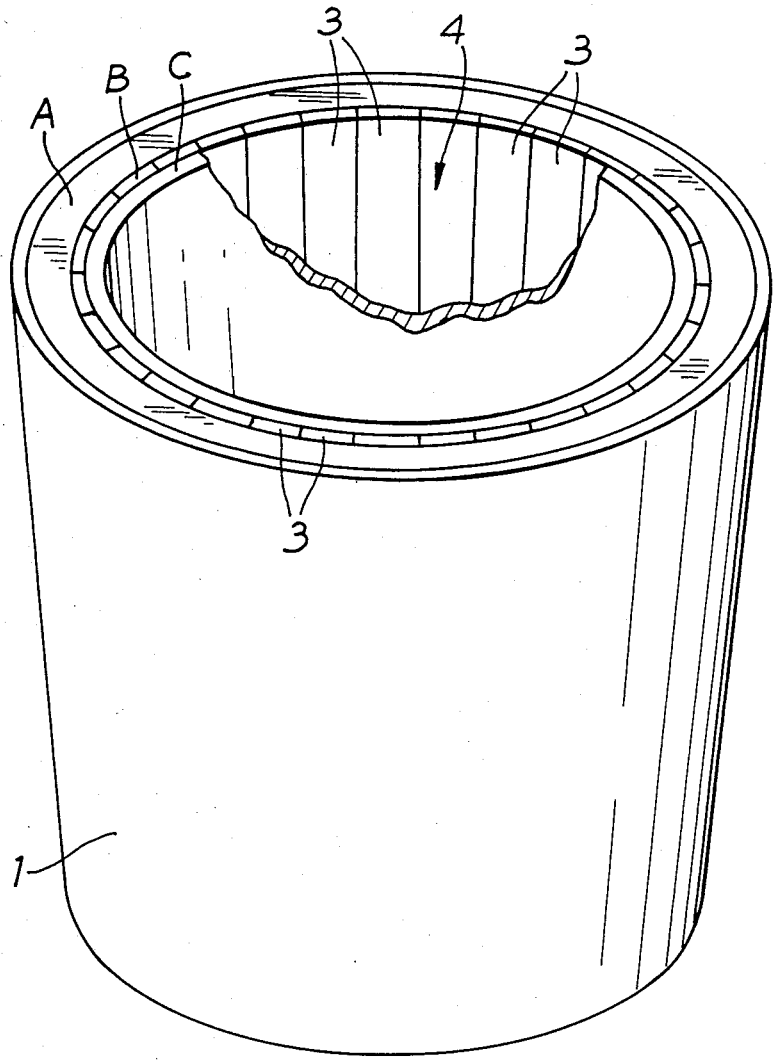
FIG. 2 is a perspective view, partly cut away, of the vessel shown in FIG. 1.

The vessel shown in the figures is a ladle designed for holding approximately three and a half tonnes of molten steel. The ladle comprises a steel bucket 1 which typically has a thickness of 7 mm, the internal dimensions of the bucket being a height of about 1.1 m and a diameter of about 1.09 m. Within the bucket 1 there is arranged a permanent outer layer A of refractory material having a thickness of about 50 mm. The outer layer A acts as a safety layer in the event that the other layers described hereinafter should be breached and may be, for example, a castable silica or silica/alumina refractory of a type which is commonly used in steel foundries.

Within the outer layer A there is provided an expendable layer B of microporous thermal insulation material such as that sold under the registered trade mark MICROTHERM and available from the Applicant. However, other microporous thermal insulation materials may be used. The thickness of the layer B is approximately 6 mm.

The microporous thermal insulation material is in the form of a number of boards of which a single board 2 covers the base of the ladle and a plurality of substantially similar boards 3 in the form of narrow slats are disposed around the side walls and extend from the base of the ladle to the rim thereof. The boards are preferably contained within an envelope of glass fibre fabric 4 and, where the narrow slats are concerned, a number of boards may be incorporated into the same glass fibre envelope which may be sewn between the adjacent slats to facilitate the formation of the slats into a curve.

Within the expendable layer B of microporous thermal insulation material there is provided an expendable inner layer C of refractory material having a thickness of about 25 mm. In use, the inner layer C is in direct contact with the molten steel. The refractory material comprising the layer C may be the same as the refractory material comprising the layer A. However, the refractory material comprising the layer C may alternatively be a high alumina refractory. High alumina refractories result in a better quality of steel than refractories which have a low or medium content of alumina because molten steel does not readily attack high alumina refractories, but high alumina refractories are not generally used because the high density and high thermal conductivity of such materials causes the molten steel to cool undesirably rapidly. We have found, however, that high alumina refractories can be used successfully in the vessel according to the present invention. The layer C may also contain silicon carbide which reduces the wetting of the refractory material by the molten steel.

The use of an insulation material in the form of boards results in an insulation layer that is easily and rapidly installed because the boards are readily handled and arranged in their required positions. The use of a separate layer of boards, rather than particulate material means that the boards are positioned prior to the application of the expendable layer C. In this way it is possible to ensure that the insulation material is distributed across the entire surface area of the layer A. Microporous thermal insulation material is particularly efficient and can be used as a relatively thin layer which does not reduce the volume of the ladle significantly. Because of the efficiency of the microporous insulation material, the thickness of the expendable layer C can be kept to a minimum which significantly increases the effectiveness of the vessel as will be described in more detail hereinafter. The expendable layer C is preferably cast or rammed into place and thus presents a continuous surface to the molten steel or other material. This reduces the liklihood of the molten steel penetrating the layer B.

The effectiveness of the vessel according to the present invention is illustrated with reference to the table which compares the performance of three lining systems. System 1 has only a single layer of refractory material which traditionally has a thickness of 75 mm. In System 2, the traditional layer of refractory material is backed up by a layer of thermal insulation material in order to reduce the heat losses from the system.

TABLE

| | SYSTEM 1<br>Single layer<br>C = 75 mm refractory | SYSTEM 2<br>2 layers<br>B = 20 mm MICROTHERM<br>C = 75 mm refractory | SYSTEM 3<br>3 layers<br>A = 50 mm refractory<br>B = 6 mm MICROTHERM<br>C = 25 mm refractory |
|---|---|---|---|
| Weight of bucket (kg) | 300 | 300 | 300 |
| Weight of layer A (kg) | — | — | 610 |
| Weight of layer B (kg) | — | 20 | 5 |
| Weight of layer C (kg) | 880 | 830 | 250 |
| Specific heats (cal/g) | | | |
| layer A | — | — | 0.27 |
| layer B | — | 0.25 | 0.25 |
| layer C | 0.26 | 0.27 | 0.28 |
| Temperature after preheating for 45 minutes (°C.) | | | |
| W | 150 | 50 | 50 |
| X | — | — | 150 |
| Y | — | 650 | 750 |
| Z | 900 | 950 | 950 |
| Temperature after pouring steel at 1620° C. and holding for 40 minutes (°C.) | | | |
| W | 400 | 100 | 100 |
| X | — | — | 250 |
| Y | — | 1000 | 1100 |
| Z | 1480 | 1490 | 1560 |
| Change in heat stored in the system as a result of pouring the molten steel (kcal) bucket | | | |
| layer A | 8000 | 2000 | 2000 |
| layer B | — | — | 12000 |
| layer C | 97000 | 104000 | 33000 |
| Transmitted heat (40 minutes) | 14000 | 2000 | 2000 |
| Heat loss from steel (kcal) | 119000 | 109000 | 50000 |
| Temperature drop in steel (°C.) | 139 | 127 | 58 |

Thus in both these prior art systems a layer of refractory material having a thickness of 75 mm is in contact with the molten steel: this is currently accepted as standard in the foundry industry.

System 3 is in accordance with the present invention and comprises a permanent safety layer, a thin expendable layer of microporous thermal insulation material and a relatively thin expendable layer of high alumina refractory in contact with the molten steel. The high alumina refractory accounts for the high specific heat of the layer C in System 3. Calculation of the thermal capacity of the layers A and C in System 3 (given by mass×specific heat) shows that the thermal capacity of layer C is approximately 43 percent of the thermal capacity of layer A.

Before molten steel is poured into the ladle it is conventional practice to preheat the ladle. This is generally accomplished by applying a gas flame to the inner layer C for about 45 minutes, but depends upon the size of the ladle. Ths results of the preheating stage are shown in the table where W represents the surface temperature of the bucket, X represents the interface temperature between the outer layer A and the layer B. Y represents the interface temperature between the layer B and the inner layer C and Z represents the temperature of the exposed surface of the layer C. It can be seen from the table that the temperatures W and Z are relatively constant except for System 1 which has a high thermal conductivity resulting in a low value for Z and a high value for W.

Molten steel is traditionally poured from the melting furnace at a temperature of about 1620° C. and can be held in the ladle for up to 40 minutes or more as the ladle is moved to the casting area and molten metal is poured into the casting moulds one at a time. The results of holding molten steel in the ladle are shown in the table, the temperatures being given approximately for the purposes of clarity. The temperature drop in the molten steel can be accounted for by the temperature increase in the lining system and the heat lost from the system. These details are given in the table and it can be seen how significant is the reduction in heat absorbed by the inner layer C. Finally, the table also gives accurate figures for the temperature drop in the molten steel after it has been held in the ladle for 40 minutes and it can be seen that System 3 results in a significant improvement over the known systems.

The advantages of the vessel according to the invention can be realised commercially in a number of different ways. For example, the temperature at which the molten steel is poured into the ladle can be reduced substantially with a corresponding saving in fuel costs and an increased working life of the inner layer C because the molten steel is less corrosive at lower temperatures and thus causes less damage to the inner layer C.

The inner layer C in the vessel according to the invention is not expected to be as durable as the inner layer C of the prior art systems, that is to say it is unlikely to reach 50 uses. However, even with a shorter life, the energy savings and the low cost of replacing only a small amount of refractory material and insulation enable the system to be economically viable.

It is also possible to use the vessel according to the present invention without preheating the vessel. When the vessel is used in this way, the performance is comparable to a known two layer system in which a lightweight insulating refractory material is backed up with a safety lining. The two layer system is less expensive, but the lightweight refractory material must be discarded after a single use whereas the vessel according to the present invention can be used many times before the layers B and C need to be replaced.

I claim:

1. In a combination comprising a furnace, a vessel for high receiving temperature bulk material from said furnace, and a means for receiving the high temperature bulk material from said vessel, the improvement wherein said vessel comprises:

an outer casing defining side walls and a base;

a permanent refractory lining covering the inner surface of the side walls and the base of the casing;

an expendable layer of relatively rigid boards of compacted microporous thermal insulation material covering essentially the entire inner surface of the permanent refractory lining in the regions of the side walls and the base of the casing and in contact therewith, said microporous thermal insulation material having a lattice structure in which the average interstitial dimension is less than the mean free path of air molecules; and an expendable layer of non-porous refractory material having a lower thermal capacity than said permanent refractory lining covering the inner surface of the layer of microporous thermal insulation material in the regions of the side walls and the base of the casing and defining a continuous surface for receiving the high temperature bulk material, and in contact with said rigid boards.

2. A combination according to claim 1, wherein the thermal capacity of the expendable layer of refractory material is substantially 50 percent of the thermal capacity of the permanent refractory lining.

3. A combination according to claim 1, wherein the expendable layer of refractory material contains a relatively high proportion of alumina.

4. A combination according to claim 1, wherein the expendable layer of refractory material contains silicon carbide.

5. A combination according to claim 1, wherein the rigid boards consist of compacted microporous thermal insulation material is contained within a glass fibre envelope.

6. A combination according to claim 5, wherein a plurality of adjacent boards are contained within a single glass fibre envelope.

* * * * *